United States Patent [19]

Tsukushi et al.

[11] 4,211,903

[45] Jul. 8, 1980

[54] ELECTROMAGNETIC PUFFER TYPE GAS CIRCUIT BREAKER

[75] Inventors: Masanori Tsukushi, Hitachi; Katsuichi Kashimura, Takahagi; Osamu Koyanagi, Hitachi; Yoshio Yoshioka, Hitachi; Kunio Hirasawa, Hitachi, all of Japan

[73] Assignee: Hitachi, Ltd., Japan

[21] Appl. No.: 805,173

[22] Filed: Jun. 9, 1977

[30] Foreign Application Priority Data

Jun. 21, 1976 [JP] Japan ..... 51-72182

[51] Int. Cl.[2] ..... H01H 33/88

[52] U.S. Cl. ..... 200/148 D; 200/148 G

[58] Field of Search ..... 200/148 D, 148 R

[56] References Cited

U.S. PATENT DOCUMENTS 4,059,741 11/1977 Yoshioka et al. ..... 200/150 G

*Primary Examiner*—Robert S. Macon

*Attorney, Agent, or Firm*—Craig & Antonelli

[57] ABSTRACT

An electromagnetic puffer type gas circuit breaker comprises two opposing puffer type gas circuit breaking units mounted on midway support means, actuating means for driving the circuit breaking units, an electromagnetic actuating unit drivingly coupled to the actuating means, and current transfer mechanism for transferring and applying the interrupting current to the electromagnetic actuating unit during a circuit breaking operation. The current transfer mechanism is located, in operative connection to the actuating means, at a point above the midway support means and in a spaced relation to the electromagnetic actuating unit. The contact surface area of the current-conducting path portion leading to the transfer mechanism is a fraction of that of another current-conducting path portion for the passage of most of the rated current. These features provide ease of inspection and replacement of the current transfer mechanism and reduces the operating force requirement of the breaker.

7 Claims, 18 Drawing Figures

ELECTROMAGNETIC PUFFER TYPE GAS CIRCUIT BREAKER

This invention relates to an electromagnetic puffer type gas circuit breaker, and more specifically to improvements in the means for transferring the interrupting current to the electromagnetic actuating unit of the breaker.

In general, the puffer type gas circuit breaker has the advantages of simple construction and no possibility of gas liquefaction. Its drawback is that a very great operating force is required where a large current, for example, in excess of 50 kA, is to be interrupted. In view of this, the so-called electromagnetic puffer type gas circuit breaker has been proposed whereby an electromagnetic force is derived from the interrupting current and is utilized as the operating force for circuit breaking or in compressing the arc-extinguishing gas. (Refer, for example, to U.S. Pat. No. 3,946,184 and U.S. Pat. Application Ser. No. 660,787, both assigned to the assignee of the present application.)

In the breaker of the U.S. patent, the mechanism for transferring and applying the current to the electromagnetic actuating unit is installed integrally with the unit. Consequently, the electromagnetic actuating unit through which the current flows constantly must of necessity be complex in construction. Further, since the electromagnetic actuating unit also serves for supporting substantially the whole construction of the circuit breaker, inspection and maintenance of the current transfer mechanism are very difficult.

According to the U.S. patent application, the current transfer mechanism is provided in the puffer type circuit breaking units. As will be described in detail later, this makes it difficult to inspect the current transfer mechanism, and necessitates prolongation of the replacement time and an increase in the number of dependable transfer duty cycles of the rated interrupting current. This is primarily responsible for the high cost of the transfer mechanism. Moreover, the sliding parts of the mechanism have such a large overall contact surface area that they create a high frictional resistance, necessitating an accordingly increased force for the closing operation.

The object of this invention is to solve the aforedescribed problems of the current transfer mechanisms of the conventional electromagnetic puffer type gas circuit breakers and to provide a breaker of the type capable of good interruption performance and which is relatively easy to inspect and replace and, because of reduced frictional resistance of the sliding parts, requires no powerful closing force.

In accordance with the invention, an electromagnetic puffer type gas circuit breaker is provided which comprises at least a pair of opposing puffer type circuit breaking units, support means disposed midway between said circuit breaking units for supporting the same, actuating means for driving said circuit breaking units, an electromagnetic actuating unit drivingly coupled to said actuating means, and current transfer means for transferring and applying an interrupting current to said electromagnetic actuating unit during a circuit breaking operation, characterized in that said current transfer means is located, in operative connection to said actuating means, at a point above said midway support means and in a spaced relation to said electromagnetic actuating unit.

Also, according to the invention, an electromagnetic puffer type gas circuit breaker is provided which comprises at least a pair of opposing puffer type circuit breaking units, support means disposed midway between said circuit breaking units for supporting the same, actuating means for driving said circuit breaking units, an electromagnetic actuating unit drivingly coupled to said actuating means, and a current transfer means for transferring and applying an interrupting current to said electromagnetic actuating unit during a circuit breaking operation, characterized in that the breaker further comprises a first current-conducting path portion electrically connected to each said circuit breaking unit to provide a passage for the greater part of the rated current and a second current-conducting path portion electrically connected to each circuit breaking unit through said current transfer means to provide a passage for the rest of the rated current when the circuit breaker is in its closed condition, said second current-conducting path portion having a contact surface area only a fraction of that of said first current-conducting path portion and being adapted to open after the opening of said first current-conducting path portion during the circuit breaking operation of the circuit breaker.

FIG. 1 is a front view of an electromagnetic puffer type gas circuit breaker of conventional design, that is of the two-interrupting-point, one-electromagnetic-drive type revealed in the above-mentioned U.S. patent application, partly broken away to show that the breaker is in the closed position.

Figure 1:
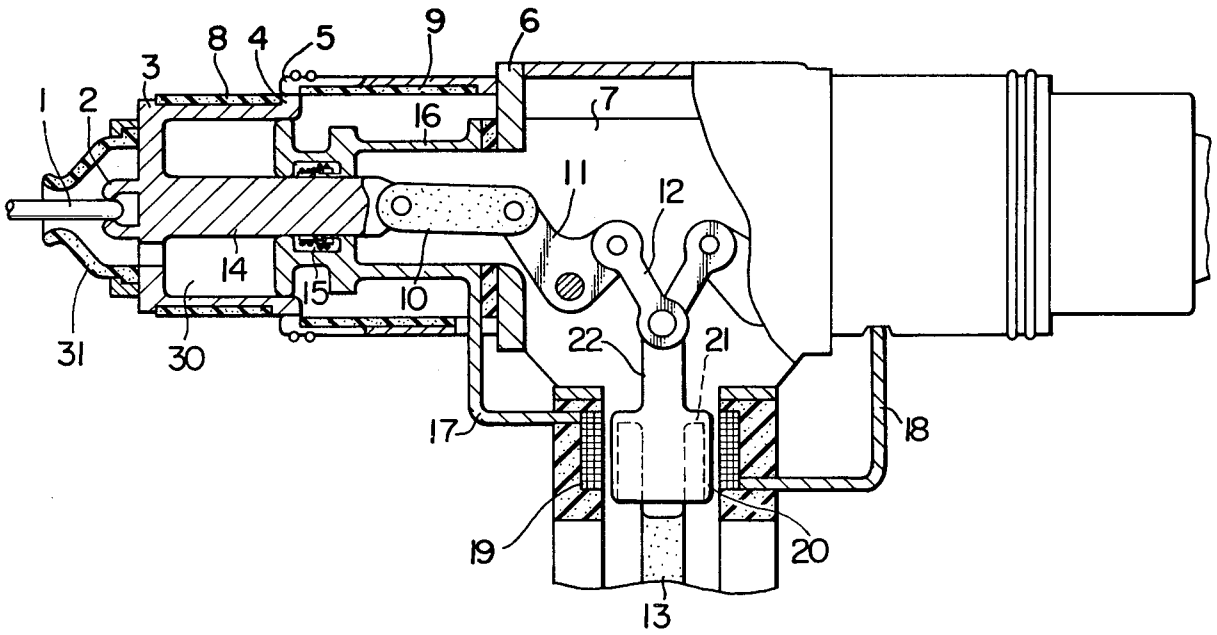
FIG. 1 PRIOR ART
FIG. 1 is a partly sectional front view of an electromagnetic puffer type gas circuit breaker of conventional design.

With reference to FIG. 1, the construction and operating principle of the electromagnetic puffer type gas circuit breaker will be explained.

When the breaker is in the closed position, the current passes in one of the two circuit breaking units, from a stationary contact 1 to a main contact 2. The current then flows through a puffer cylinder 3, secondary main contact 4, conductor 5, terminal 6, and crankcase 7 into the other circuit breaking unit. The operation of the other unit is identical with that of the unit just mentioned and the description is not repeated here.

With this arrangement, typically with the left-hand one of the two units, the circuit breaking is carried out in the following way.

As an insulated operating rod 13 is forced downward by external drives not shown, its motion is transmitted through links 11, 12 and an insulated link 10 so as to pull the puffer cylinder 3 rightward, that is, in the circuit breaking direction. Together with the cylinder the main contact 2 recedes away from the stationary contact 1, and an arc-extinguishing gas in a puffer chamber 30 is compressed and is puffed out through a nozzle 31 against the arc produced between the stationary contact 1 and the main contact 2. This circuit breaking motion of the puffer cylinder 3 brings the secondary main contact 4 formed in one piece with the cylinder out of contact with the conductor 5. The arc that results therebetween is urged into a narrow gap formed between insulating cylinders 8, 9 for example, of polytetrafluoroethylene, on the outer surface of the puffer cylinder 3 and on the inner surface of the conductor 5. Consequently, the current flowing through the puffer cylinder 3, secondary main contact 4, and conductor 5 is interrupted. It passes instead through the shaft 14 of the puffer cylinder 3, current collector 15, stationary piston support 16, coil-connecting terminal 17, coil 19, and coil-connecting terminal 18, in the order mentioned, to the other circuit breaking unit. As a result, the coil 19 is excited and a powerful electromagnetic repulsive force, produced between the coil and an electrically conductive cylinder 20 located inside the coil, is transmitted through a rib 21 and a center rod 22 to the link 12. Thus the great electromagnetic repulsive force is applied in the circuit breaking direction of the drives for the puffer arrangement. It then coacts with the operating force and serves to reduce accordingly the force required for the circuit breaking operation.

The electromagnetic puffer type gas circuit breaker of the construction described, which offers many advantages, needs as a major component a mechanism for transferring the interrupting current to the electromagnetic actuating unit at the time of circuit breaking. The current transfer mechanism is required to be (1) quite trouble-free when normally conducting the rated current, and (2) capable of rapidly transferring the short-circuit current in the range from 63 to 80 kA to the electromagnetic actuating unit.

Various experiments have made it clear that the conventional current transfer mechanism shown in FIG. 1, which draws in an arc between the insulating cylinders 8 and 9 and extinguishes the same in the narrow gap, fully meets the two requirements mentioned above. However, the actual construction of the mechanism has nevertheless had problems yet to be solved, as will be described below.

Usually the nozzle 31, stationary contact 1, main contact 2 and the like of each circuit breaking unit are replaced after having served about ten times for the interruption of the rated interrupting current. In the case of the so-called grounded-tank type construction in which the circuit breaking units are all housed in a grounded metal container, the circuit breaking units can be replaced through inspection holes formed in the grounded tank rather than being taken out for disassembling outside. This is a major advantage because the inspection and disassembling time is considerably shortened and there is no need of a special tool for taking out the circuit breaking units.

By contrast, the current transfer mechanism of the conventional electromagnetic puffer type gas circuit breaker shown in FIG. 1 is not readily accessible for replacement by way of the inspection hole. In order to replace the mechanism, it is necessary to disconnect the cylindrical conductor 5 from the terminal 6 of the crankcase 7 located midway between the two circuit breaking units, and then remove the insulating cylinders 9 and 8. This disassembling work is all done in the axial (closing) direction of the circuit breaking unit. There is not an easy access to the parts through the inspection hole formed on one side of the tank for the inspection of the nozzle 31 and the like, because the hole is limited in diameter lest it impair the strength of the tank. Also, any attempt to reach the conductor 5 and the crankcase 7 from the inspection hole so as to disconnect them from each other would involve difficulties, necessitating an additional hole at a sacrifice of the tank strength. Moreover, the cylindrical conductor 5 is too large in diameter and too heavy to be taken out through the inspection hole, even if it could be disconnected from the rest of the assembly. If the manual work was feasible via the inspection hole, the period of time required would be longer than when the nozzle 31 and the like are replaced. Understandably, such an extended downtime is undesirable in view of the role the gas circuit breaker plays.

It has therefore been common practice to prolong the replacement time and decrease the frequency of inspection. For this purpose the current transfer mechanism has had to be designed so that the number of its dependable duty cycles of transferring the rated interrupting current is several to about ten times as many as that of the nozzle 31 and the like. This has been largely responsible for the high cost of the component parts such as the insulating cylinders 8, 9 and secondary main contact 4. In addition, the sliding motions of the insulating cylinders 8, 9 secondary main contact 4, and conductor 5, which combinedly have a rather large overall contact surface area, produce a frictional resistance of no small magnitude. In view of this, it has been necessary to design the breaker so that a sufficiently strong force can be exerted for its closing operation.

Constructing the current transfer mechanism in a way different from that which has so far been described, if attempted at, would encounter difficulties. Since the aforementioned two conditions the transfer mechanism is required to satisfy are conflicting, it is inevitable to use a large-size mechanism in order to meet the both requirements, especially where the rated current to be handled is high, for example, in the range from 8000 A to 12000 A. Such a large current transfer mechanism is difficult to drive quickly.

The duty of the current transfer mechanism during the circuit breaking operation is comparable to that of an ordinary molded case circuit breaker, as the former deals with a voltage of at most several hundred volts although the amperage is high. Further, because the primary coil 19 of a low impedance is connected in parallel with the mechanism, it would be possible, only if there was no duty of passing the rated current, to reduce the size or simplify the construction of the mechanism to such an extent that the technique of arc-extinguishing mechanism incorporated in the molded case circuit breaker might be applicable.

After all, there has been no current transfer mechanism, other than the one shown in FIG. 1, which satisfies both of the abovementioned conditions. An improved mechanism therefore has been called for which will provide a relatively easy access for inspection and replacement while fully meeting the two requirements.

An embodiment of this invention, which realizes the improvement, will now be described in conjunction with FIGS. 2 through 6, where like parts have been given like numerals with respect to FIG. 1 showing the prior art circuit breaker.

In the center of the circuit breaker is located a crankcase 7 as midway support means, and a stationary piston support 16 is attached to the crankcase through an insulation. Around the support 16 is slidably fitted a puffer cylinder 3, which has a main contact 2 at its outer end. A stationary contact 1 is disengageably fitted into this main contact 2, and around this stationary contact 1 and the main contact 2 is provided a nozzle 31 of an arc-extinguishing material for guiding the arc-extinguishing gas flow from the puffer chamber 30 of the puffer cylinder 3.

A shaft 14 formed in the center of the puffer cylinder 3 extends through the stationary piston support 16. Its inwardly extended end is connected to an insulated operating rod 13 through an insulated link 10, links 11, 12, and a center rod 22. On the center rod 22 is fixedly mounted an electrically conductive cylinder 20 through a rib 21 and, surrounding this cylinder 20, a coil 19 is attached to the crankcase 7 through an insulation. A coil-connecting terminal 17 at one end of the coil 19 is connected to the stationary piston support 16, and the other coil-connecting terminal 18 to the other circuit breaking unit.

The puffer cylinder 3 is generally shaped as a bottomed cylinder. It has a secondary main contact 4 protruding in the form of a rib around its open end, and also includes a tertiary main contact 23 of the same thickness as the secondary main contact 4, formed on about one-eighth of its circumference and over its entire length. (Refer to FIG. 3.) A primary conductor 5 adapted to contact the circumference of the secondary contact 4 of the puffer cylinder 3 is shaped as a cylinder partly cut away. The portion of the primary conductor 5 to contact the secondary contact 4 is slit, and annular springs 5A are fitted around that portion to ensure an intimate contact between the conductor 5 and the secondary contact 4. The secondary contact 4 and the primary conductor 5 combinedly constitute a first current-conducting path portion. A secondary conductor 24 thicker and longer than the primary conductor 5 is held in the cutaway part of the primary conductor 5 and aligned to the tertiary contact 23 of the puffer cylinder 3, in a spaced relation to the primary conductor 5. This secondary conductor 24 too is adapted to contact the tertiary contact 23 securely with the annular springs 5A. An insulation 5B is interposed between the secondary conductor 24 and the annular springs. The tertiary contact 23 and the secondary conductor 24 combinedly constitute a second current-conducting path portion.

The secondary conductor 24 is connected to a current transfer mechanism 25, which in turn is located on an extension line from the center rod 22 and is adapted to be engaged or disengaged by an operating rod 27 and a link 26 pivotally connected to the link 12.

Figure 5A:
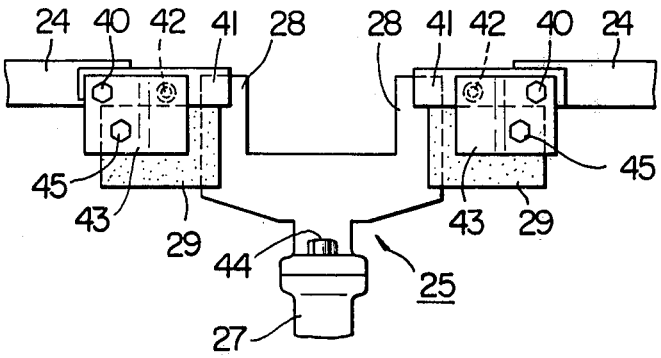
FIG. 5A is an enlarged front view of the current transfer mechanism of the embodiment with current applied.
Figure 5B:
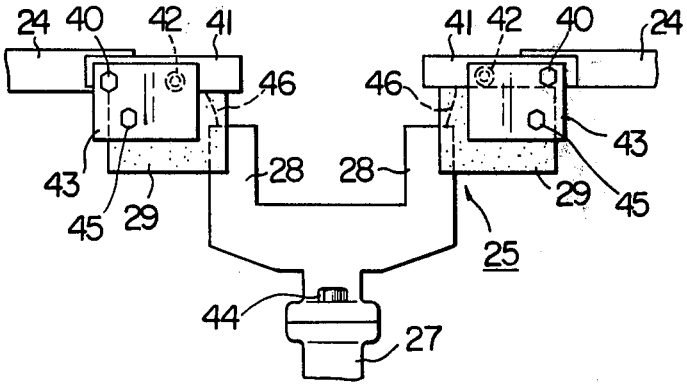
FIG. 5B is a view similar to FIG. 5A but showing the mechanism with current interrupted.
Figure 5C:
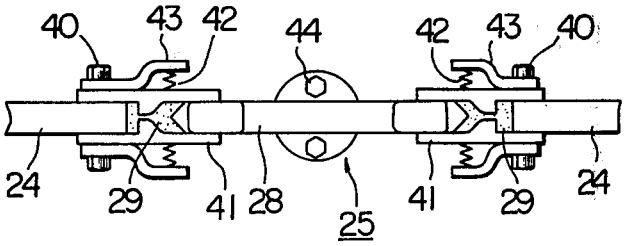
FIG. 5C is a plan view of the mechanism.
Figure 6:
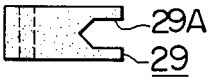
FIG. 6 is an enlarged plan view of the arc-extinguishing plate incorporated in the mechanism.

As better shown in FIGS. 5A to 5C, the current transfer mechanism comprises two pairs of stationary contacts 41 each pair of which is fastened, together with side plates 43 to one end portion of the secondary conductor 24 by bolts 40, a two-armed movable contact 28 mounted on the operating rod 27 by bolts 44 so as to be movable into and out of contact with the stationary contacts 41, two arc-extinguishing plates 29 each of which is attached to the side plates 43 by bolts 45 and adapted to generate an arc-extinguishing gas upon formation of an arc between the movable contact 28 and each pair of stationary contacts 41, and two pairs of compressing springs 42 each of which is interposed between each said side plate 43 and each said stationary contact 41 to ensure the contact between the stationary contacts 41 and the movable contact 28.

The operation of this embodiment will now be explained.

Figure 2:
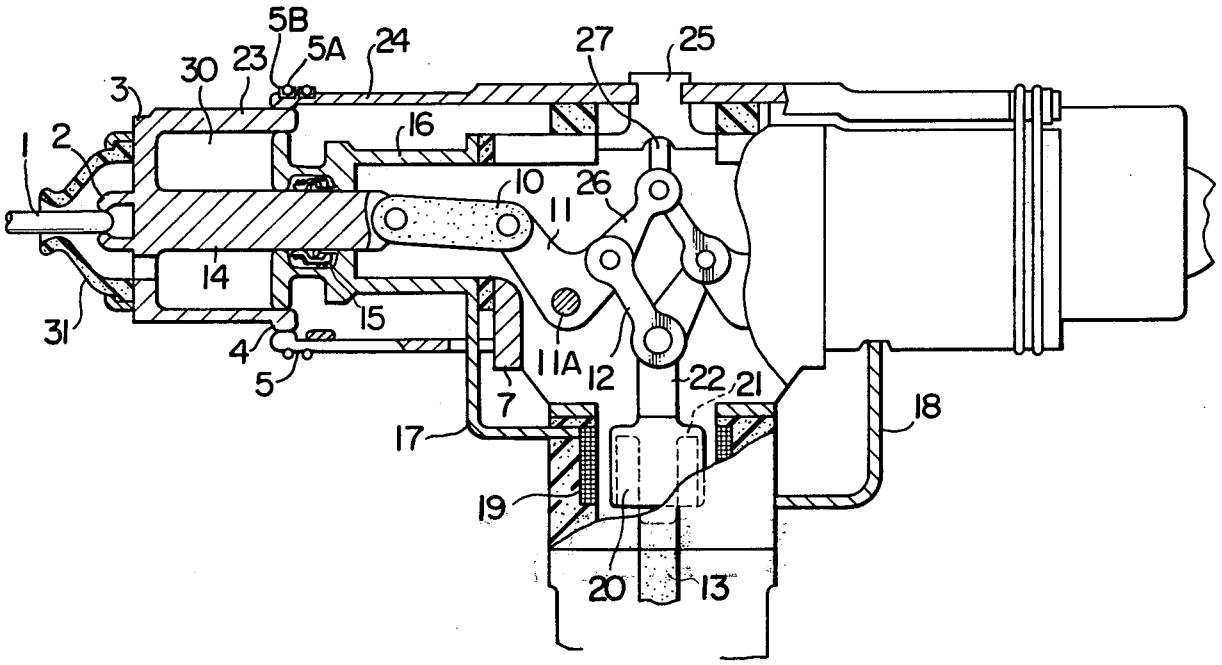
FIG. 2 is a view corresponding to FIG. 1 but showing an embodiment of the invention.
Figure 3:
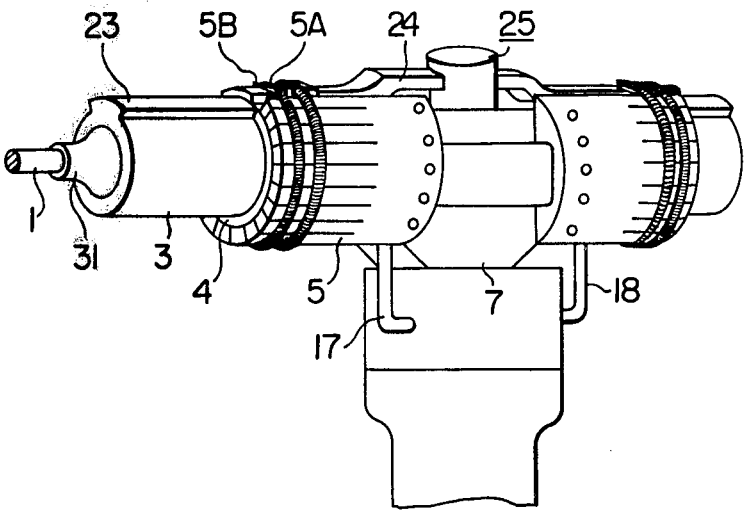
FIG. 3 is a perspective view of the embodiment.
Figure 4:
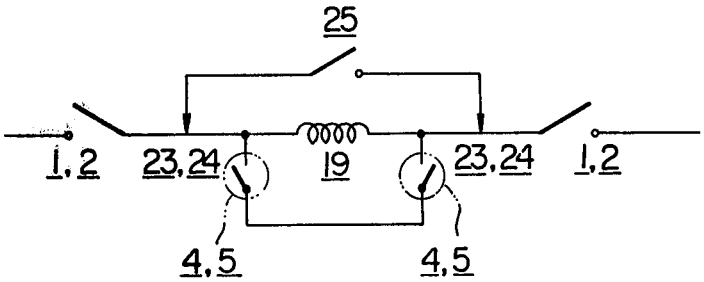
FIG. 4 is a skeleton diagram of the electric circuit for the embodiment.

When the circuit breaker is closed as in FIG. 2, the current flows from the stationary contact 1 of the circuit breaking unit to the main contact 2 and thence, through the puffer cylinder 3, secondary main contact 4, primary conductor 5, and crankcase 7, to the opposite circuit breaking unit. At the same time, the current passes from the stationary contact 1 to the main contact 2, puffer cylinder 3, tertiary main contact 23, secondary conductor 24, and stationary contact 41 and movable contact 28 of the current transfer mechanism 25 and then to the other circuit breaking unit. Since the contact surface area of the tertiary main contact 23 is approximately one-eighth of the total outer surface area of the puffer cylinder 3, most of the rated current flows to the secondary main contact 4, making it practically unnecessary for the current transfer mechanism 25 to perform the duty of passing the rated current. This is obvious from FIG. 4 which illustrates the electric circuit for the circuit breaker of FIG. 2 in the form of a skeleton diagram. As can be seen, the both secondary main contacts 4 and the conductors 5 are in contact and the current transfer mechanism 25 need not have the duty of handling the rated current as long as the circuit breaker is in the closed position.

For the circuit breaking operation, the puffer cylinder 3 is driven first to bring the secondary main contact 4 out of engagement with the primary conductor 5 in the manner already described in connection with the prior art arrangement shown in FIG. 1. In this state, the tertiary main contact 23 and the secondary conductor 24 are in contact and will remain to be so until the final stage of the operation. Thus, despite the parting of the secondary main contact 4 and the primary conductor 5, no arc will be produced therebetween by dint of the interrupting current, and the current flows from the tertiary main contact 23 to the conductor 24. As the center rod 22 is driven by the circuit breaking operation, the operating rod 27 of the current transfer mechanism 25 to which the conductor 24 is connected is moved in the circuit breaking direction, that is, downward as viewed in FIG. 2, through links 12, 26. As a result, the current flowing through the conductor 24 is shut off by the current transfer mechanism 25. Thus, the interrupting current is transferred to the coil 19. This excites the coil 19 to create a powerful electromagnetic repulsive force in the conductive cylinder 20, thus aiding in the current breaking operation, in the same manner as with the conventional arrangement described earlier.

The function of the current transfer mechanism 25 will now be explained in further detail with reference to FIGS. 5A to 5C. In FIG. 5A where the breaker is in the closed position, the current flows through the secondary conductor 24 and the movable conductor 28 of the circuit breaking unit to the secondary conductor 24 of the other circuit breaking unit. At this time, the main current-conducting path portion composed of the secondary main contact 4 and the primary conductor 5 are already parted open. FIG. 5B illustrates the circuit breaking condition. The arc 46 drawn between the stationary contacts 41 and the movable contact 28 is urged by virtue of its own electromagnetic force into the groove 29A of the arc-extinguishing plate 29 (FIG. 6), where it is rapidly quenched, and the arc voltage increases until the current transfer and interruption is concluded. FIG. 5C is a plan view of the current transfer mechanism 25.

The stationary contacts 41 and the movable contact, when damaged by arcing during the current transfer and interruption, may be replaced. Should this happen, it is only necessary to loosen the bolts 40, 45 and remove the stationary contacts 41 and the arc-extinguishing plate 29, together with the side plates 43, from the conductor 24, and then separate the movable contact 28 from the operating rod by removing the bolts 44.

As stated, the current transfer mechanism 25 in this embodiment is provided above the crankcase 7. It is therefore accessible for inspection and maintenance through an inspection hole formed in the shell portion of a grounded tank or in the corresponding portion of some other construction of the breaker. The hole for inspecting the nozzle 31 and other associated parts may be utilized for this purpose. The current transfer mechanism, which does not need to perform the duty of interrupting the rated current, may be made small in size and light in weight. In addition, it may be of any construction optimum for the current transfer. In this way an electromagnetic puffer type gas circuit breaker with enhanced reliability and good breaking performance is provided. Because of a reduced overall contact surface area of the components, the frictional resistance is less and the breaker requires a smaller operating force for closing than the prior art breakers.

Figure 7:
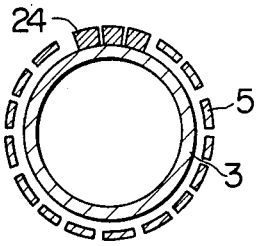
FIG. 7 is a cross sectional end view of a puffer cylinder in another embodiment of the invention.

FIG. 7 shows a modification of the contacting parts of the puffer cylinder 3 and the conductor 5. Instead of forming the land of the tertiary main contact 23 on a part of the puffer cylinder 3 as in FIG. 3, this puffer cylinder 3 is made perfectly circular in cross section. The secondary conductor 24 connected to the current transfer mechanism 25 is flush with the conductor 5 but thicker inward so that, regardless of its stroke, the puffer cylinder 3 is constantly engaged with the secondary conductor 24. This modification provides greater ease of machining the puffer cylinder 3 than the arrangement of FIG. 4.

Figure 8:
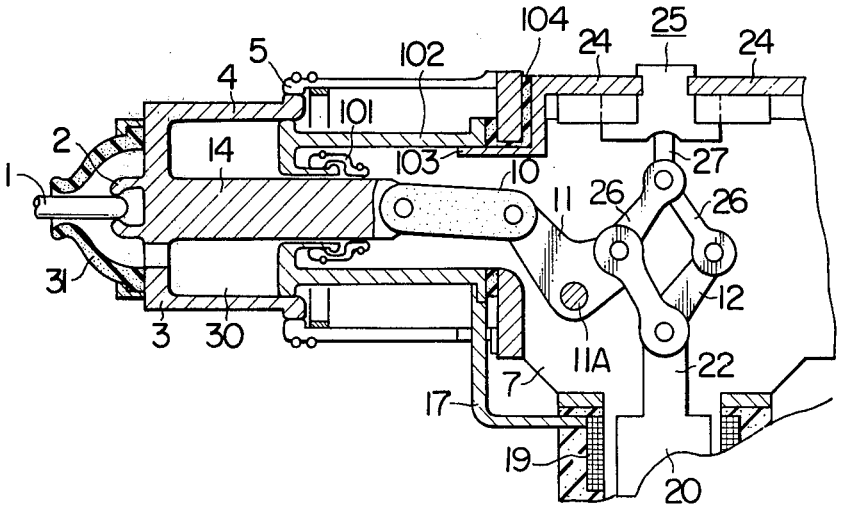
FIG. 8 is a fragmentary sectional view of essential parts of still another embodiment of the invention.

In FIG. 8, the secondary main contact 4 and the conductor 5 are adapted to contact each other along their entire circumferences. As the stroke of the puffer cylinder progresses, the secondary main contact 4 is moved away from the primary conductor 5. After they have been separated, the current passes through a current collector 101 in contact with the shaft 14 of the puffer cylinder 3, a piston support 102, and a connecting conductor 103 to the secondary conductor 24 leading to the current transfer mechanism 25. The numeral 104 designates an insulating seat supporting the secondary conductor 24. While the embodiment shown in FIG. 8 functions in exactly the same manner as that of FIG. 2, it has an additional advantage of ease of machining because the arrangement of the puffer cylinder 3 and the primary conductor 5 are rotationally symmetric.

Figure 9:
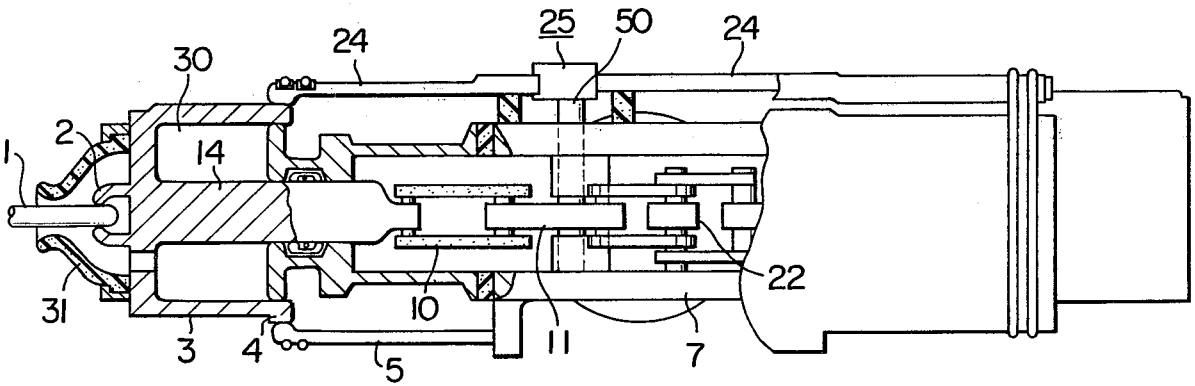
FIG. 9 is a partly sectional plan view of yet another embodiment.
Figure 10:
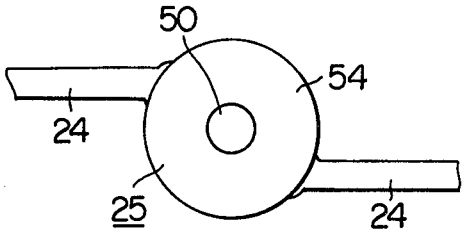
FIG. 10 is an enlarged front view of the current transfer mechanism shown in FIG. 9.
Figure 11:
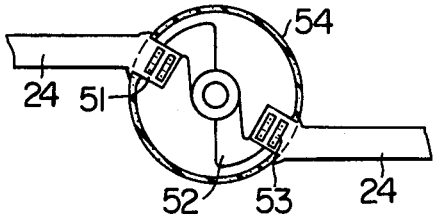
FIG. 11 is a partly sectional front view of the mechanism with current applied.
Figure 12:
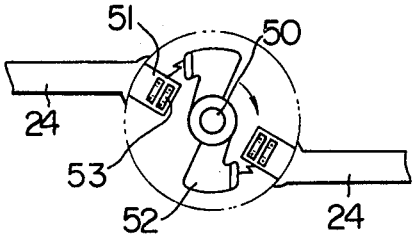
FIG. 12 is a view similar to FIG. 11 but showing the mechanism with current interrupted.

FIG. 9 shows another embodiment in which the current transfer mechanism 25 is installed alongside the crankcase 7. In this case the current transfer mechanism 25 is driven by the rotation of a rod 50. Here the fixed support 11A for the link 11 in FIG. 2 is replaced by a rod adapted to cooperate with the link 11 and extended axially to be the rod 50. FIGS. 10 to 12 illustrate the current transfer mechanism of the embodiment shown in FIG. 9. As the rod 50 rotates in the direction of the arrow in FIG. 12, rotating contacts 52 secured to the rod 50 for rotation therewith are parted from stationary contacts 51 on the both secondary conductors 24. In FIGS. 11, 12 the numeral 53 indicates leaf springs for ensuring the engagement of the stationary contacts 51 with the rotating contacts 52, and the numeral 54 indicates an insulating housing accommodating those stationary and rotating contacts. Although the current transfer mechanism 5 operates rotationally in this embodiment, essentially the same arc-extinguishing principle as with the embodiment of FIG. 5 is applicable. Here the operating rod 27 of FIG. 5 may be driven by a suitable connecting rod provided between the rod 27 and the rod 50. As will be obvious to those skilled in the art, the location of the current transfer mechanism is not limited in any way, it may be located above or alongside the crankcase 7.

Figure 13:
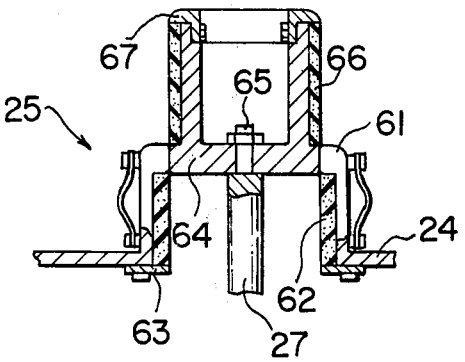
FIG. 13 is a sectional front view of a cylindrical current transfer mechanism with current applied.
Figure 14:
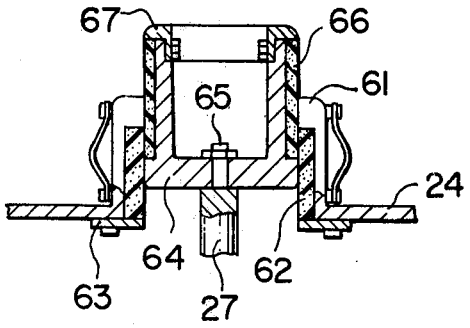
FIG. 14 is a view similar to FIG. 14 but showing the mechanism with current interrupted.
Figure 15:
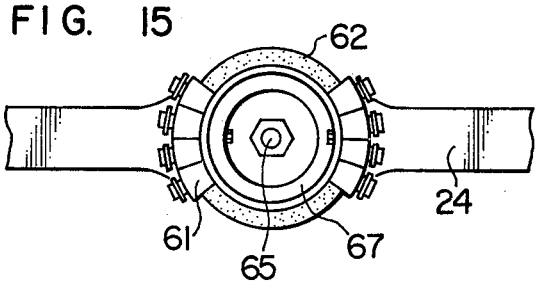
FIG. 15 is a plan view of the mechanism.

Also, while the current transfer mechanism of the embodiment shown in FIG. 5 is of a flat plate construction based on the narrow-gap arc-extinguishing principle, this is not a limitation to the invention; it may, for example, be of a cylindrical construction that works on the same principle. Further, it may have simple parallel contacts as embodied in FIGS. 10 to 12. In the cylindrical current transfer mechanism, as indicated in FIGS. 13 to 15, arcuate stationary contacts 61 rise from the opposing ends of the secondary conductors 24. In the recesses formed on the inner sides of the opposing stationary contacts, an insulating cylinder 62 of polytetrafluoroethylene, for example, is concentrically fitted and is secured in place by clamps 63. In the space defined by the stationary contacts 61 and the insulating cylinder 62, a cylindrical movable contact 64 is mounted on the operating lever 27 by bolts 65, slidably with respect to the stationary contacts. An insulating cylinder 66 of polytetrafluoroethylene or the like is placed around, and secured by a retainer 67 to a reduced diameter section of the movable contact 64. The contacting sides of the stationary contacts 61 are slitted, and leaf springs 68 disposed outside of the contacts exert pressures thereon so as to ensure the contact between the stationary and movable contacts. In the closed position as shown in FIG. 13, the current from one circuit breaking unit passes through the conductor 24, stationary contact 61, movable contact 64, the other stationary contact to the conductor 24 of the other circuit breaking unit. Then, as shown in FIG. 14, the movable contact 64 is pulled downward by the operating rod 27, when arcs generated between the stationary contacts 61 and the movable contact 64 are drawn and extinguished in the narrow gap defined between the both insulating cylinders 62, 66.

Figure 16:
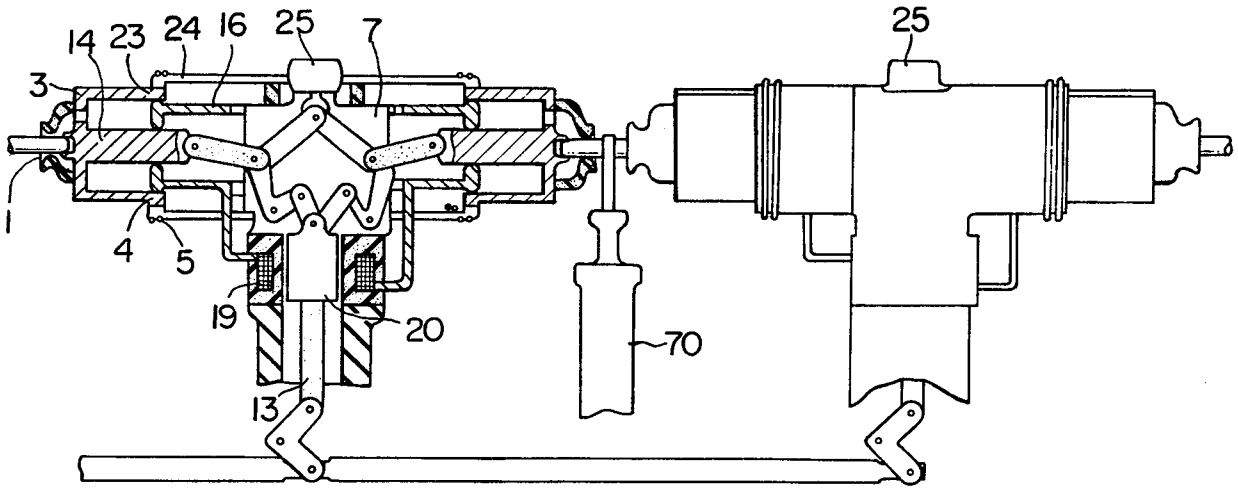
FIG. 16 is a front view of four-interrupting-point, two-electromagnetic-drive arrangement, one of the two circuit breaking units being shown in section to illustrate the interior structure.

Although some embodiments of the two-interrupting-point, one-electromagnetic-drive type have been described, it is to be understood that the present invention is not limited thereto but is applicable to breakers using electromagnetic drives for four interrupting points as shown in FIG. 16 or for more interrupting points. In FIG. 16 the reference numeral 70 denotes an insulating support. The other parts corresponding to those in FIG. 2 are indicated by like numerals.

As will be obvious from the foregoing description, the current transfer mechanism according to the present invention is much easier to inspect and maintain than the prior art ones, and permits the breaker to be closed with less force requirement.

What is claimed is:

1. An electromagnetic puffer type gas circuit breaker comprising at least a pair of opposing puffer type circuit breaker units, support means disposed midway between said circuit breaking units for supporting the same, actuating means for driving said circuit breaking units, an electromagnetic actuating unit drivingly coupled to said actuating means, and current transfer means for transferring and applying the interrupting current to said electromagnetic actuating unit during a circuit breaking operation, characterized in that said current transfer means is located, in direct operative connection to said actuating means, on said midway support means and in a spaced relation to said electromagnetic actuating unit.

2. A circuit breaker as claimed in claim 1, wherein said current transfer means comprises stationary contacts attached to the opposing ends of conductors extended from the two puffer type circuit breaking units, said contacts having grooves on the opposing ends, a movable contact operatively connected to said actuating means and adapted to be disengageably fitted in said grooves of said stationary contacts, arc-extinguishing members secured to the ends of said stationary contacts toward which said movable contacts travels in the circuit breaking motion, said arc-extinguishing members having grooves aligned to said grooves of said stationary contacts, and means for exerting pressures on said stationary contacts to ensure the contact between said stationary and movable contacts.

3. A circuit breaker as claimed in claim 1, wherein said current transfer mechanism comprises actuate stationary contacts concentrically disposed opposite to each other on opposing ends of conductors extended from the two puffer type circuit breaking units, an insulating cylinder fixed on the inner sides of said stationary contacts concentrically therewith, a cylindrical movable contact disposed inside said stationary contacts and said insulating cylinder and adapted to slide therein in operative connection to said actuating means, an insulating cylinder fitted around said movable contact, and means for exerting pressures on said stationary contacts to ensure the contact between the stationary and movable contacts.

4. A circuit breaker as claimed in claim 1, wherein said current transfer mechanism comprises stationary contacts attached to the opposing ends of conductors extended from the two puffer type circuit breaking units, said stationary contacts extending into an insulating housing fixed to said conductors and having circumferential grooves formed in the opposing inner ends, a rotating shaft extending through the center of said insulating cylinder and operatively connected to said actuating means, a pair of movable contacts mounted on said rotating shafts and adapted to be disengageably inserted into said grooves of said stationary contacts, and means for exerting pressures on said stationary contacts to ensure the contact between said stationary and movable contacts.

5. An electromagnetic puffer type gas circuit breaker comprising at least a pair of opposing puffer type circuit breaking units, support means disposed midway between said circuit breaking units for supporting the same, actuating means for driving said circuit breaking units, an electromagnetic actuating unit drivingly coupled to said actuating means, and a current transfer means for transferring and applying the interrupting current to said electromagnetic actuating unit during a current breaking operation, characterized in that the breaker further comprises a first current-conducting path portion electrically connecting said circuit breaking units to provide a passage for the greater part of the rated current and a second current-conducting path portion electrically connecting said circuit breaking units through said current transfer means when the circuit breaker is in its closed condition, said second current-conducting path portion having a contact surface area only a fraction of that of said first current-conducting path portion and being adapted to be kept closed until the final stage of the circuit breaking operation of the circuit breaker.

6. A circuit breaker as claimed in claim 5, wherein said first current-conducting path portion comprises a main contact protruding like a rib along the outer periphery of the open end of the puffer cylinder, in the form of a bottomed cylinder, of each said puffer type circuit breaking unit, and cylindrical primary conductor secured to said midway support means concentrically with said puffer cylinder, said cylindrical primary conductor being partly cut away and having at one end an inward protrusion in contact with said main contact, and said second current-conducting path portion leading to said current transfer means comprises another contact formed as thick as said main contact on an area only a fraction of the circumference of said puffer cylinder and over the entire length of said cylinder, and a secondary conductor disposed in said cutaway part of said cylindrical primary conductor, said secondary conductor having an inward protrusion at one end for contacting another contact and being connected at the other end to said current transfer mechanism.

7. A circuit breaker as claimed in claim 5, wherein said first current-conducting path portion comprises a main contact protruding like a partly cut away rib along the outer periphery of the open end of the puffer cylinder, in the form of a bottomed cylinder, of each said puffer type circuit breaking unit, and a cylindrical primary conductor secured to said midway support means concentrically with said puffer cylinder, said cylindrical primary conductor being partly cut away and having at one end an inward protrusion in contact with said main contact, and said second current-conducting path portion leading to said current transfer means comprises the outer periphery of said puffer cylinder, and a secondary conductor connected to said current transfer means and disposed in the cutaway part of said cylindrical primary conductor in alignment to said cutaway part of sad main contact protruding like a rib, said secondary conductor being made thicker inward than said primary conductor so as to contact said outer periphery of said puffer cylinder.

* * * * *